United States Patent [19]

Chen

[11] Patent Number: 4,868,933

[45] Date of Patent: Sep. 26, 1989

[54] FLUSH CONTROL DEVICES

[76] Inventor: Tsai-An Chen, 201, Sec. 3, Ba-Dar, Taipei, Taiwan

[21] Appl. No.: 191,126

[22] Filed: May 6, 1988

[51] Int. Cl.[4] ..... E03D 3/10

[52] U.S. Cl. ..... 4/355; 4/364; 4/382; 4/415; 137/409; 137/422; 137/428

[58] Field of Search ..... 4/366, 378, 379, 381, 4/382, 383, 384, 385, 386, 387, 363, 364, 365, 355, 415, 393; 242/96; 137/409, 422, 294, 426, 427, 428, 414

[56] References Cited

U.S. PATENT DOCUMENTS

| | | | |
|---|---|---|---|
| 213,920 | 4/1879 | McKissock | 137/426 X |
| 342,495 | 5/1886 | Barker | 4/406 |
| 580,208 | 4/1897 | Cahill | 4/366 X |
| 655,233 | 8/1900 | Heuck | 137/426 |
| 1,503,686 | 8/1924 | Grilich | 137/422 |
| 1,736,719 | 3/1928 | Morro | 4/382 |
| 2,366,755 | 1/1945 | Rogne | 242/96 |
| 2,836,829 | 6/1958 | Eddowes | 4/366 |
| 3,005,465 | 10/1961 | Whitlock et al. | 251/294 |
| 3,036,591 | 5/1962 | Eddowes | 137/426 |
| 4,502,166 | 3/1985 | Brown, Sr. | 4/252 R |

FOREIGN PATENT DOCUMENTS

| | | | |
|---|---|---|---|
| 545818 | 3/1956 | Belgium | 4/366 |
| 389054 | of 0000 | United Kingdom | 137/409 |

OTHER PUBLICATIONS

"Mircle Toilet Valve", Pacer Plumbing Products, per U.S. Pat. No. 2,990,555, 6/10/57, 4–393.

*Primary Examiner*—Henry J. Recla

*Attorney, Agent, or Firm*—Morton J. Rosenberg; David I. Klein

[57] ABSTRACT

A flush control device for controlling the flush operation of a flush toilet having a cistern, a feed water control mechanism fluidly coupled to a water supply pipe and a flush water control mechanism fluidly coupled to one end of a flush pipe, the opposing end of which is connected to a toilet bowl. The flush control device includes a float coupled to the feed water control mechanism for operating the mechanism to stop water supply as the float reaches a predetermined water level. At the end of the flush operation, the descent of the float will operate the flush control mechanism to end the flow of water from the cistern to the flush pipe and operate the feed water control mechanism to supply water into the cistern again.

5 Claims, 5 Drawing Sheets

FLUSH CONTROL DEVICES

FIELD OF THE INVENTION

This invention relates to a control device for flush control, and particularly to a flush control device of a flush toilet.

BACKGROUND OF THE INVENTION

Conventionally, a variety of flush toilets are widely used in homes or public sanitation facilities. It is found that the constructions of the flush control devices of the flush toilets are complicated, and the corrosion of the submerged parts cause problems in use and considerable expense must be paid for professional services for repair. To this end, the inventor has attempted to make an improved flush control device to overcome the drawbacks noted heretofore.

SUMMARY OF THE INVENTION

An object of this invention is to provide a flush control device which can diminish the disadvantages of known flush control devices.

With the above object in view, this invention provides a flush control device including a cistern for water storage, a feed water control mechanism, and a flush water control mechanism, spacedly installed in the cistern. The feed water control mechanism includes a feed water control unit bastened to the bottom wall of the cistern and communicating with a water supply pipe, and housing a top-shaped body from which a connecting rod upwardly protrudes therefrom. The connecting rod is suspended from the bottom of a water level float, with a string and thereby elevated to close the outlet of the feed water control unit by the buoyancy of the water level float as the water level reaches a predetermined height. The flush water control mechanism includes a flush water control unit fasten to the bottom wall of the cistern and communicating with a flush pipe connected to a toilet bowl. A control arm defined by a pair of forked prongs is pivotally mounted transversely on the lid of the flush water control unit and biased with a torsional force by means of a helical spring while one of the prongs which has a hook end is limited by a lateral rod and the other prong extends toward the feed water control mechanism with its end portion located under the float. The lid can be actuated to open by pressing a flush lever disposed on the front wall of the cistern while the hook end is elevated to catch the limiting rod and thus retained to hold the lip opened. By the end of the flush, the descending water level float will strike the end portion of the prong of the control arms to release the hook end from the limiting rod by a reverse torque so that the lid returns to close the flush water control unit by gravity. The descending water level float will also strike the top-shaped body by the top end of the connecting rod to drop so that the feed water control unit is opened for water supply.

DETAILED DESCRIPTION OF THE PREFERRED EMBODIMENT

The following is a detailed description of the best presently contemplated embodiment of the invention. This description is not to be taken in a limiting sense, but is made merely for the purpose of illustrating the general principles of the invention.

Figure 1:
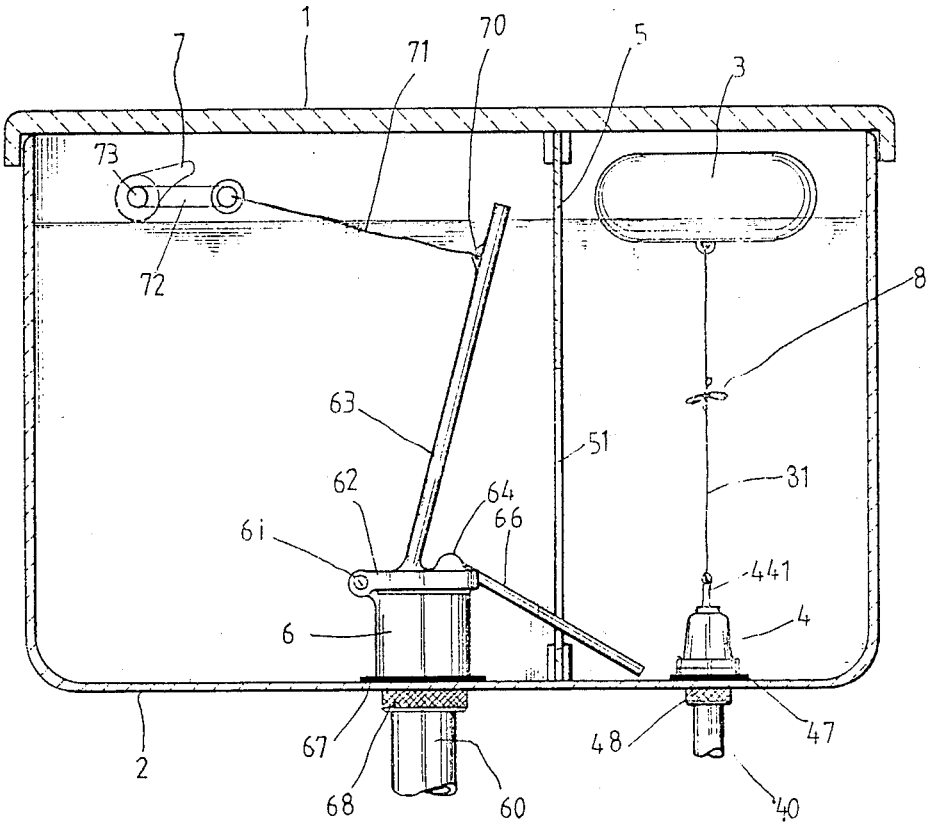
FIG. 1 is a cross-sectional view of a preferred embodiment according to the present invention.

As shown in FIG. 1, a flush water control device according to the present invention includes a cistern 2 with a lid 1 for water storage, which is separated into two compartments by means of a partition board 5 having an opening 51 communicating between the two compartments formed therein. The partition 5 extends vertically from the cistern to the lid 1. A feed water control mechanism and a flush water control mechanism are installed in a respective one of the two compartments.

The feed water control mechanism includes a feed water control unit 4, communicating with a water supply pipe 40 and having a connecting rod 441 upwardly protruding therefrom. Feed water control unit 4 is retained on the bottom wall of the cistern 2 with a nut 48 and a rubber gasket 47 incorporated therebetween. A water level float 3 and a string 81 with an adjuster 8, for adjusting the distance of the string 81, interconnects the water level float 3 and the connecting rod 441.

The flush water control mechanism includes a flush water control unit 6, having a pivoted watertight lid 62 actuated to rotate about a pin 61 and communicating with a flush pipe 60 connected to a toilet bowl (not shown) generally located in a water closet. The flush water control unit 6 is retained on the bottom wall of the cistern 2 with a nut 68 and a rubber gasket 67 incorporated therebetween. A control arm 66 is pivotedly mounted transversely on a projector 64 disposed on the lid 62. An operating lever 63 extends upwardly from the upper surface of the lid 62 to a position above the water level in cistern 2. An actuating lever 72 is actuated by a flush lever 7 generally disposed on the front wall of the cistern 2 and adapted to rotate about an axis 73 so as to draw said operating lever 63 to open the lid 62 with a string 71 connected to the upper portion of the operating lever 63 at a connecting point 70.

Figure 2:
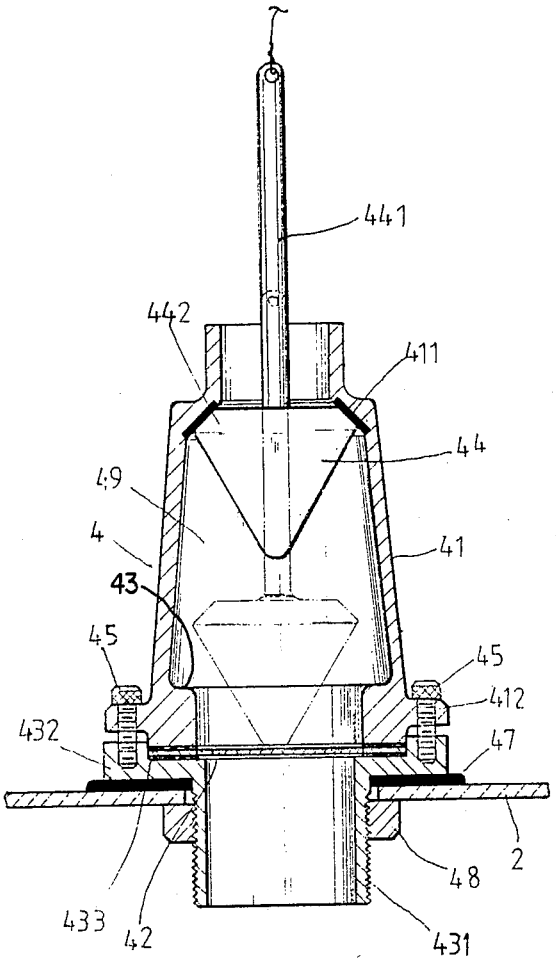
FIG. 2 is a cross-sectional view of a feed water control unit.

The feed water control unit 4, as shown in FIG. 2, is provided with a passage 49 running vertically therethrough for feeding water into the compartment from the connected water supply pipe 40. The feed water control unit 4 includes an upper case 41 in which is housed a top-shaped body 44 vertically movable therein. The upper case 41 is provided with a flange 412 protruding outwardly from the lower periphery thereof and having a plurality of holes vertically formed therein. The feed water control unit 4 further includes a wire net 42 and a seat means 43, having a supporting plate 432 mounted on the bottom wall of the cistern 2 and a cylindrical wall 431 extending downwardly through said bottom wall and having a threaded outer periphery for engaging with a nut 48 to fasten the seat means 43 thereon. The supporting plate 432 further includes a recess 433 formed in the top surface of supporting plate 43. The inner periphery of the recess is in corresponding relation to the outer periphery of a lower end portion extending downwardly from the bottom of the flange 412 of the upper case 41. Support plate 433 is provided with a plurality of holes having internal threads corresponding to respective holes formed in the flange 412 and located in an outer surface around the recess 433 for coupling the seat means 43 and the upper case 41, with the wire net 42 incorporated therebetween, by tightly engaging the bolts 45 inserted through respective holes formed in the flange 412.

The upper case 41 has a convergent portion 411 formed at the outlet end of the passage 49, and the top-shaped body 44 housed therein is formed with an upper conical plug end 442, secured to the lower end of the connecting rod 441, which is suspended by the connecting string 81. Conical plug end 442 is defined by a convergent periphery adapted to mate with the convergent portion 411 of the upper case 41 for closing the outlet of the passage 49 as the top-shaped body is elevated to the upmost position in the outer case 41, as the float 3 rises with water level in the cistern 2.

Figure 3:
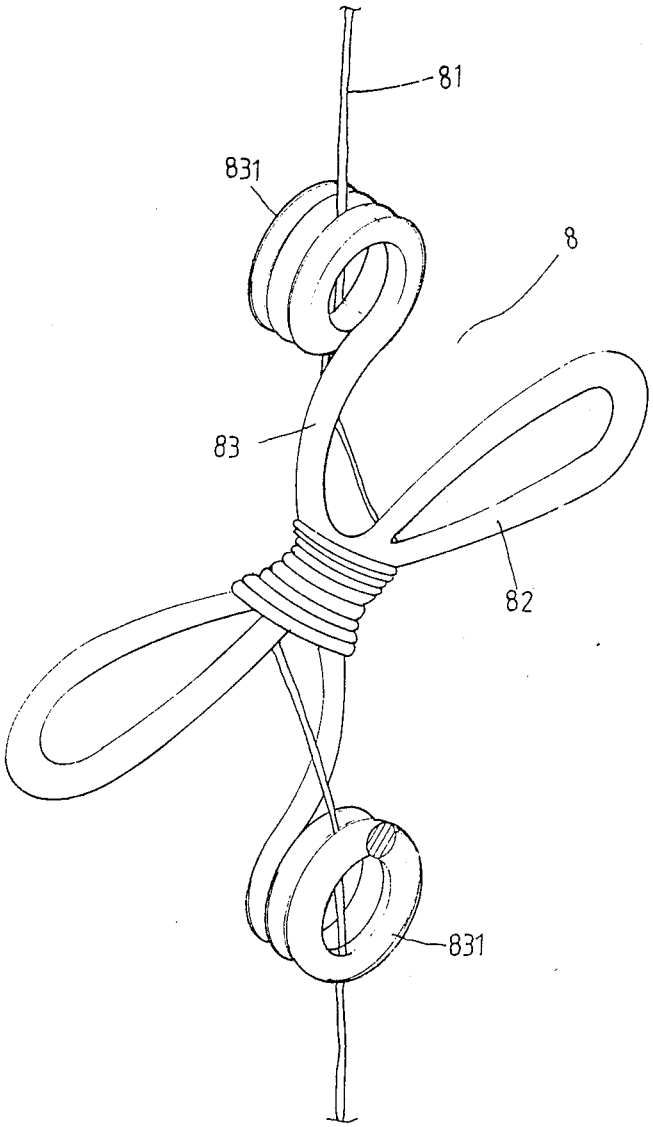
FIG. 3 is an enlarged perspective view of a string length adjuster and wound string.

The adjuster 8, as shown in FIG. 3, comprises a handle member 82 and a retainer 83 having spiral ends 831 on opposing ends for retaining the string between adjacent coils. Handle member 82 and retainer 83 are intersected at their middle portions. The string 81 can be wound on the intersecting portion with its free ends retained by the spiral ends 831.

Figure 4:
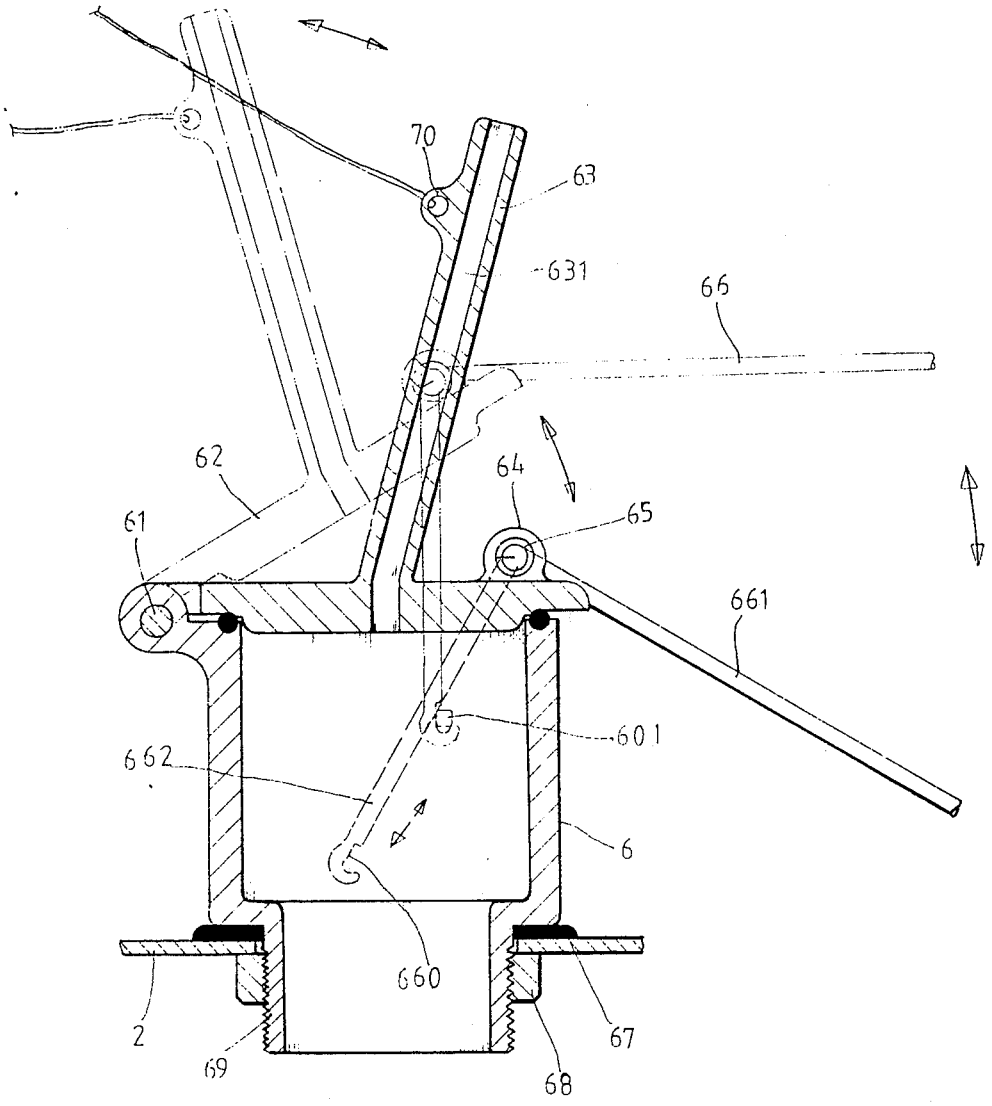
FIG. 4 is a cross-sectional view of a flush water control unit.
Figure 5:
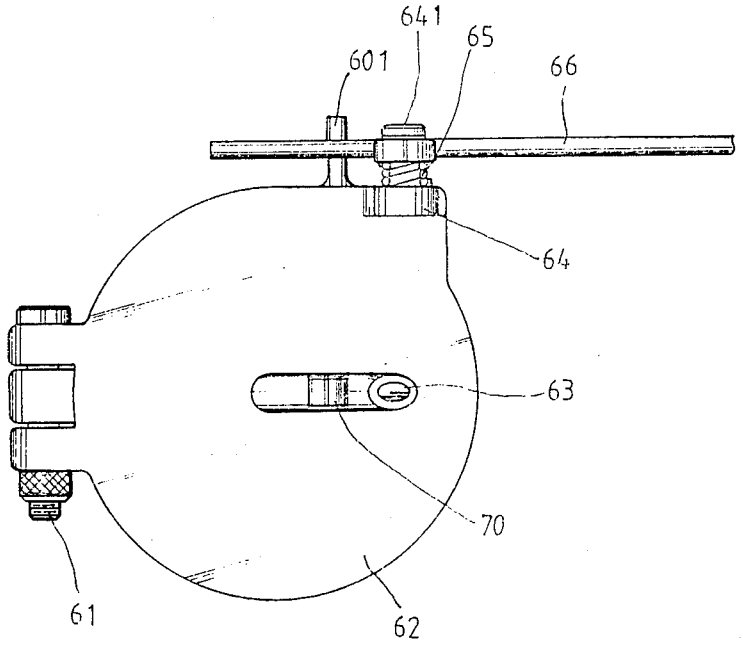
FIG. 5 is a schematic plan view of a flush water control unit.

The flush water control unit 6, as particularly shown in FIGS. 4 and 5, of the flush control mechanism includes a cylindrical wall 69 extending downwardly through the bottom wall of the cistern 2 and having a threaded outer periphery for engaging with a nut 68 to fasten the unit 6 on the bottom wall. The control arm 66 mounted pivotedly on a shaft 641 is transversely disposed on the projector 64 and has forked prongs 661 and 662 which form substantially a right angle between them. A torsional force is exerted upon the prong 662, whose rotation is limited by a rod 601 laterally projected from the periphery of the flush water control unit 6, by a helical spring 65 mounted over the shaft 641 so that the control arm 66 tends to rotate about the shaft 641 so as to force prong 662 against rod 601, and the end portion of the other prong 661 protrudes into the adjacent compartment through the opening 51 of the partition board 5 and resides in a position under the float 3.

The operating lever 63 has a passage 631 extending longitudinally therethrough and through the lid 62 to communicate with the space defined by the unit 6 for draining away any excess of water in the cistern 2 and thus preventing it from overflowing.

In operation, the water supply pipe 40 supplies water into the cistern 2 through the passage 49 of the feed water control unit 4. The top-shaped body 44 is gradually elevated to close the outlet of the passage 49 as the predetermined water level is reached by the buoyancy of the water level float 3, coupled thereto by string 81 and connecting rod 441.

When the flush lever 7 is pressed to rotate the operating level 72 coupled to the lid 62, such causes lid 62 to rotate about the pin 61 to open the flush water control unit 6. A hook end 660 of the prong 662, limited by the rod 601, is elevated to catch the rod 601 and thereby retain the lid 62 in an open condition. The water level and the water level float 3 descend during the flush, while the feed water control unit 4 remains closed by the top-shaped body 44 which is supported by the feed water pressure. The descending float 3 will sequentially or simultaneously strike the top end of the prong 661 of the control arms 66, to release the hook end 660 from the rod 601 by a reverse torque, and then strike the connecting rod 441 to force the top-shaped body 44 downward to overcome the feed water pressure and drop down to the top surface of the wire net 42. By so doing, the lid 62 watertightly closes the flush water control unit 6 to end the flush and the water supply is conducted into cistern 2 again.

By the aforementioned construction, it can be seen that the water level of the present invention is easy to select according to the users' demands, and is simple in construction of installation or replacement.

Obviously, many modifications and variations of the present invention are possible in light of the above teachings. It is to be understood therefore, that within the scope of the appended claims, the invention my be practiced otherwise than as specifically described herein.

What is claimed is:

1. A flush control device comprising:

a cistern with a lid for water storage, said water having a predetermined level within said cistern;

a feed water control mechanism disposed within the cistern including a feed water control unit coupled to the cistern through a first through opening formed in a bottom wall of said cistern, said feed water control unit having a water supply passage extending through said first through opening for fluid coupling on one end with a water supply source and providing a water outlet into said cistern on the opposing end, said opposing end being defined by an upper portion of said feed water control unit having an internal converging portion, said feed water control unit further including a control body member disposed within said water supply passage and having a mating convergent peripheral surface for closing said water supply passage outlet responsive to a float rising to a predetermined height for establishing said predetermined water level, said float being coupled to said control body member by a string and a connecting rod extending from said control body member, wherein said control body member maintains said water supply passage outlet in a closed condition until said float contacts said connecting rod responsive to a predetermined decrease of said water level within said cistern during a flush operation; and, a flush water control mechanism disposed within the cistern and spaced from said feed water control mechanism including a flush water control unit coupled to the cistern through a second through opening formed in said bottom wall, said flush water control unit including (1) a drain passage extending through said second through opening for fluid coupling on one end with a flush pipe, (2) a lid member for closing an inlet disposed on the opposing end of said drain passage, (3) a lever extending upwardly from the lid to a predetermined height above said water level and operatively coupled to a flush handle for opening said lid and thereby beginning said flush operation, and (4) means for holding open said lid, said means for holding open said lid having a control arm extending from said flush water control unit toward said feed water mechanism for releasing said lid responsive to said float contacting an end portion of said control arm, whereby said float sequentially contacts said control arm followed by said connecting rod for ending said flush operation prior to refilling said cistern.

2. The flush control device as recited in claim 1 wherein an adjuster is further provided for adjusting the length of said string, said adjuster having a handle member and a retainer member having spiral ends on opposing ends thereof for retaining said string, said handle member intersecting said retainer member, the intersection defining a storage area for an excess length portion of said string wound thereon.

3. The flush control device as recited in claim 1 further comprising a partition member vertically disposed withing said cistern and having a through opening formed therein for passage of said control arm therethrough for restricting the horizontal movement of said float.

4. The flush control device as recited in claim 1 wherein said flush control unit lever includes an overflow passage fluidly coupled to said flush passage through said lid and extending coaxial said upward extension of said lever for draining away water accumulating above said predetermined height of said lever.

5. The flush control device as recited in claim 1 wherein said feed water control unit further includes a support plate member having a flange coupled to a respective flange formed on said upper portion of said feed water control unit, and a wire net captured between said flanges for limiting downward displacement of said control body member.

* * * * *